US008272166B2

(12) United States Patent
Nezu

(10) Patent No.: US 8,272,166 B2
(45) Date of Patent: Sep. 25, 2012

(54) SELF-PROPELLED FORWARD MOVEMENT MECHANISM OF MOVABLE BODY AND SLIDING DOOR

(75) Inventor: Mikio Nezu, Fujisawa (JP)

(73) Assignee: Nifco Inc., Yokohama-Shi (JP)

( * ) Notice: Subject to any disclaimer, the term of this patent is extended or adjusted under 35 U.S.C. 154(b) by 859 days.

(21) Appl. No.: 12/226,521

(22) PCT Filed: Jan. 29, 2007

(86) PCT No.: PCT/JP2007/051417

§ 371 (c)(1),
(2), (4) Date: Dec. 2, 2008

(87) PCT Pub. No.: WO2007/122831

PCT Pub. Date: Nov. 1, 2007

(65) Prior Publication Data

US 2010/0293859 A1 Nov. 25, 2010

(30) Foreign Application Priority Data

Apr. 20, 2006 (JP) ..... 2006-116587

(51) Int. Cl.
*E05F 11/00* (2006.01)

(52) U.S. Cl. ..... 49/358

(58) Field of Classification Search ..... 49/360, 49/275, 138, 358; 91/508
See application file for complete search history.

(56) References Cited

U.S. PATENT DOCUMENTS

| | | | | |
|---|---|---|---|---|
| 3,298,546 | A * | 1/1967 | Jones | 432/242 |
| 3,771,823 | A * | 11/1973 | Schnarr | 292/270 |
| 5,072,973 | A * | 12/1991 | Gudgel et al. | 292/55 |
| 5,901,992 | A * | 5/1999 | Winkler | 292/270 |
| 2007/0068081 | A1 * | 3/2007 | Hoermann | 49/197 |
| 2011/0023370 | A1 * | 2/2011 | Zimmer et al. | 49/360 |

FOREIGN PATENT DOCUMENTS

| | | |
|---|---|---|
| JP | S53-34134 | 3/1978 |
| JP | A 53-54847 | 5/1978 |
| JP | S56-1910 U | 1/1981 |
| JP | U 60-191669 | 12/1985 |
| JP | H11-229705 | 8/1999 |
| JP | 2005-290769 | 10/2005 |
| JP | 2006-045803 | 2/2006 |
| JP | 2006-169905 | 6/2006 |

* cited by examiner

*Primary Examiner* — Jerry Redman
(74) *Attorney, Agent, or Firm* — Manabu Kanesaka

(57) ABSTRACT

A catcher 2 includes a catcher stopper 21, a holder 22 for a striker 1, and a biasing member 23 for the catcher stopper and the holder. When the catcher stopper 21 is projected by the biasing member 23, the holder 22 is set in a forward position and in a non-holding state, and when the holder 22 is set in a backward position and in a holding state, the catcher stopper 21 is withdrawn. The recess Mb has an engageable hole 402 formed therein for engagement with the catcher stopper 21, and a force is stored in the biasing member 3 when the catcher 2 is set in a reference position where the catcher stopper 21 is brought into engagement with the engageable hole 402. The sticker 1 enters the holder 22 of the catcher 2 when the catcher is set in the reference position since the movable member M is moved forward to a self-propelled movement start position.

6 Claims, 14 Drawing Sheets

SELF-PROPELLED FORWARD MOVEMENT MECHANISM OF MOVABLE BODY AND SLIDING DOOR

TECHNICAL FIELD

The present invention relates to a system, which is configured to automatically move a movable member forward up to a stop position after the movable member is moved forward to a self-propelled movement start position, the movable member having an upper portion housed in and supported by a rail-like member and a sliding door utilizing the system.

BACKGROUND ART

As a door closure for sliding doors, there has been proposed one which is configured to withdraw a sliding door by moving an engageable member backward under the action of a spring after the engageable member is swung from a standby position for receiving the engageable pin to an engagement position by a closing operation and has an engageable pin received in a holding recess, the engageable member having the holding recess formed therein for engagement with the engageable pin disposed on the sliding door (see Patent Document 1 listed below).

However, the door closure configured as described above needs to have a space in a width direction thereof for allowing the engageable member to swing, which make it difficult to the door closure compact in the width direction. Even if the engageable pin strikes against the engageable member, the withdrawing of the sliding door under the action of the spring does not start before the engageable member has swung to the engagement position.

Patent Document 1: JP-A-2005-290769

DISCLOSURE OF THE INVENTION

Object to be Accomplished by the Invention

It is a main object to be solved by the present invention that a system, which is configured to automatically move a movable member forward up to a stop position in a reliable way after the movable member has been moved forward to a self-propelled movement start position, can be disposed without need for an excessive space in a right-to-left direction of the movable member.

Means of Solving the Problems

In order to attain the object, the present invention provides a self-propelled forward movement system for a movable member, which is characterized to have the following features (1) to (8):

(1) The self-propelled forward movement system is adapted to automatically move a movable member forward up to a stop position after the movable member is moved forward to a self-propelled movement start position, the movable member being adapted to have an upper portion housed in and supported by a rail-like member. The system includes:

(2) a striker configured to be disposed in the rail-like member;

(3) a catcher configured to be housed in a recess so as to be movable along a moving direction of the movable member, the recess being formed in the upper portion of the movable member so as to extend along the moving direction;

(4) a biasing member for the catcher;

(5) the catcher including a catcher stopper, a holder for a striker, and a biasing member for the catcher stopper and the holder, the catcher stopper being disposed so as to protrude and enter with respect to a catcher body, the holder being disposed so as to be movable forward and backward and receive the striker from forward in a non-holding state;

(6) the catcher stopper being configured so that when the catcher stopper protrudes from the catcher body, the holder is set in a forward position and in the non-holding state by the biasing member, and when the holder is set in a backward position and in a holding state, the catcher stopper is withdrawn into the catcher body; and (7) the recess having an engageable hole, which the catcher stopper is brought into engagement with when protruding, the engageable hole being disposed to store a force in the biasing member when the catcher is set in a reference position where the catcher stopper is brought into engagement with the engageable hole;

(8) wherein the sticker enters into the holder of the catcher when the catcher is set in the reference position in a case where the movable member is moved forward to the self-propelled movement start position.

Before the movable member is forward moved to the self-propelled movement start position, the holder protrudes forward to the maximum, and the catcher stopper is brought into engagement with the engageable hole (the catcher is set in the reference position). When the movable member is moved forward to the self-propelled movement start position, the striker enters the recess from forward, and the holder is moved backward against the action of the biasing member, being pressed by the striker, which has entered in the recess. When the holder is moved backward, the holder is set in a holding state. Thus, the catcher captures the striker and is united with the striker. At the same timer, the catcher stopper is withdrawn into the catcher body to get out of the engageable hole by the backward movement of the holder. When the catcher stopper is brought out of engagement with the engageable hold of the casing in this manner, the movable member is automatically moved up to the stop position by the biasing member. When the movable member, which has been automatically moved forward to the stop position, is moved backward to the self-propelled movement start position, the catcher is relatively moved up to the reference position, storing a force in the biasing member, the catcher stopper is brought into engagement with the engageable hold again, and the striker is released from the holder, separating the catcher and the striker from each other. Since the holder merely moves along the moving direction of the movable member between the forward position and the backward position, it is possible to advantageously minimize the size of the movable member in a right-to-left direction in the self-propelled forward movement system.

The holder may include a slider and a pair of right and left holding flaps, the slider being combined with the catcher body so as to be movable in forward and backward directions, and the slider being integrally jointed to the paired holding flaps by resin hinges, which extend between a front end of the slider and rear ends of the holding flaps.

In a case where the system is configured in this way, when the holder is moved backward against the action of the biasing member, being pressed by the striker, since the movable member has been forward moved to the self-propelled movement start position, the striker, which has entered the holder, can be held with the distance between the paired holding flaps being narrowered while the resin hinges are elastically deformed.

The recess may include an inner wall extending along the moving direction of the movable member, the inner wall having cut-out portions partly formed therein so as to receive at least outer portions of the holding flaps of the catcher under an elastic action of the resin hinges when the catcher is set in the reference position.

In this case, it is not necessary to increase the size of the self-propelled forward movement system in the right-to-left direction in a portion of the system where the movable member has been moved forward to the self-propelled movement start position. The holder can be set in the non-holding state where the distance between the paired holding flaps is spread by provision of the cut-out portions. When the holder is moved backward against the action of the biasing member, being pressed by the striker, since the movable member has been moved forward to the self-propelled movement start position, the holding flaps is caused to get out of the cut-out portions, narrowing the distance between the paired holding flaps, elastically deforming the resin hinges by right and left side walls of the casing. Thus, the holder is set in the holding state.

The system may further include a spacer having protruding sliders, which protrude laterally on both right and left sides of the movable member so as to constantly provide a gap between an inner surface of the rail-like member and each of both right and left sides of the movable member. In this case, the spacer may include elastic strips, which are elastically deformable in a direction to be away from the inner surface of the rail-like member, the elastic strips having the protruding sliders disposed thereon.

In each of these cases, the movable member is supported through the protruding sliders by the rail-like member without wobbling in such a state that the sliding resistance of the movable member during movement is minimized by keeping the upper portion of the movable member out of contact with the inner surface of the rail-like member. The spacer centers the movable member so that the movable member has a substantially middle portion in a width direction set at a substantially middle portion of the rail-like member in the width direction. Thus, the striker is reliably captured by the catcher where the catcher is set in the reference position in the recess in a case where the movable member is moved forward to the self-propelled movement start position. In a case where the protruding sliders are disposed on the elastic strips, when a pressing force is applied to the movable member toward either one of the right side and the left side of the rail-like member, the elastic strips are deformed to allow the movable member to shift toward the one side, and when the pressing force is released, the elastic strips are elastically restored to the original state to reset the movable member in the initial position.

In a case where the system is applied to a sliding door, when the sliding door is manually closed (moved forward) to a desired self-propelled movement start position, the sliding door is automatically moved forward up to the stop position where a front edge of the sliding door strikes against a door stop post or the front edge of a sliding door as the counterpart.

Effect of the Invention

The system according to the present invention, which is configured to automatically move the movable member forward up to the stop position in a reliable way after the movable member has been moved forward to the self-propelled movement start position, can be disposed without need for an excessive space in the right-to-left direction of the movable member.

BEST MODE FOR CARRYING OUT THE INVENTION

Now, embodiments with the present invention embodied therein will be described in reference to FIG. 1 to FIG. 16.

Figure 1:
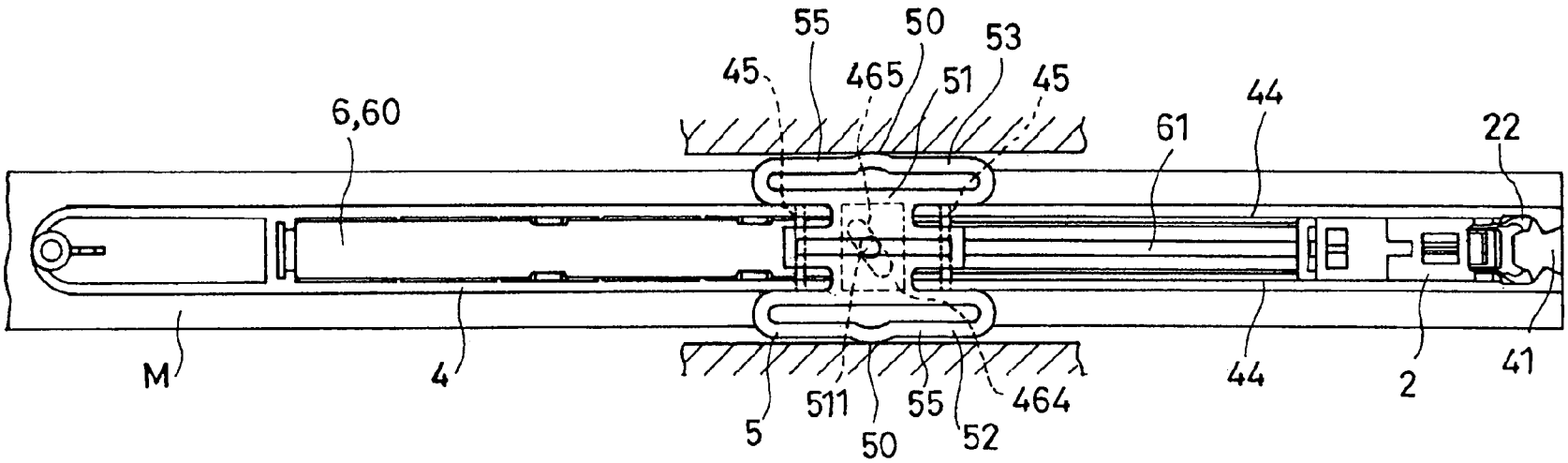
FIG. 1 is a schematic plan view of the self-propelled forward movement system according to an embodiment of the present invention.
Figure 2:
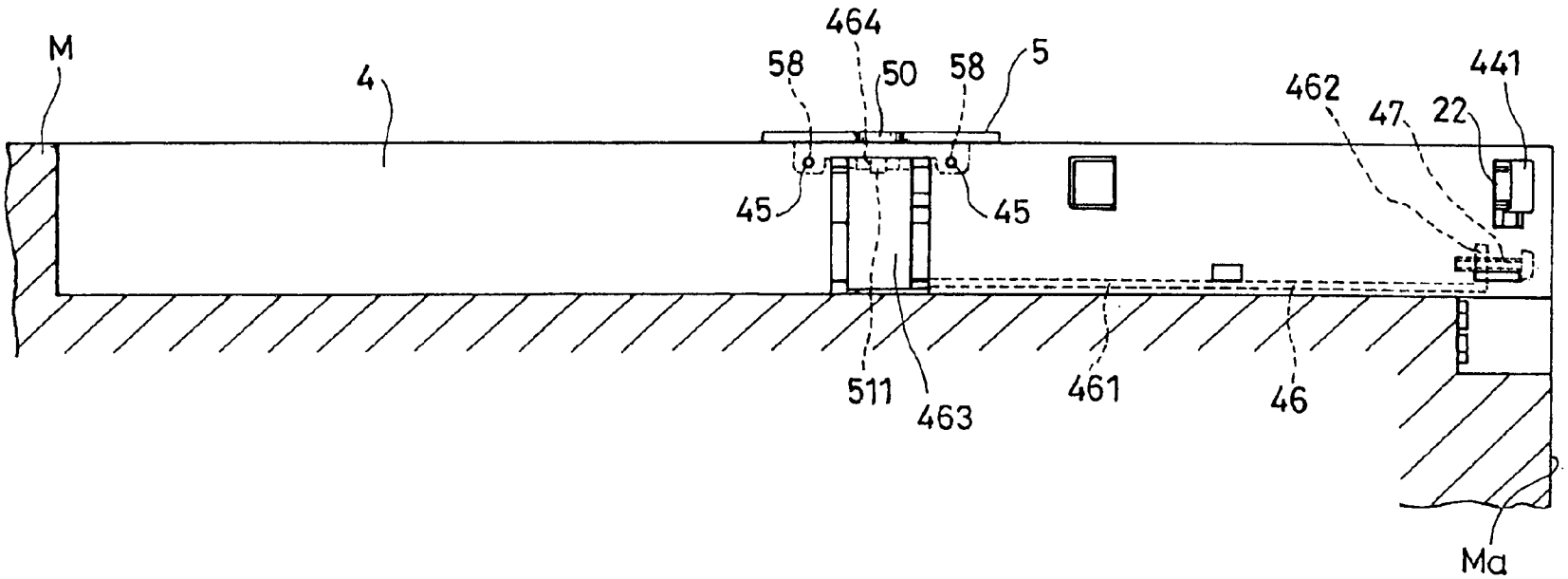
FIG. 2 is a schematic side view of the self-propelled forward movement system.
Figure 3:
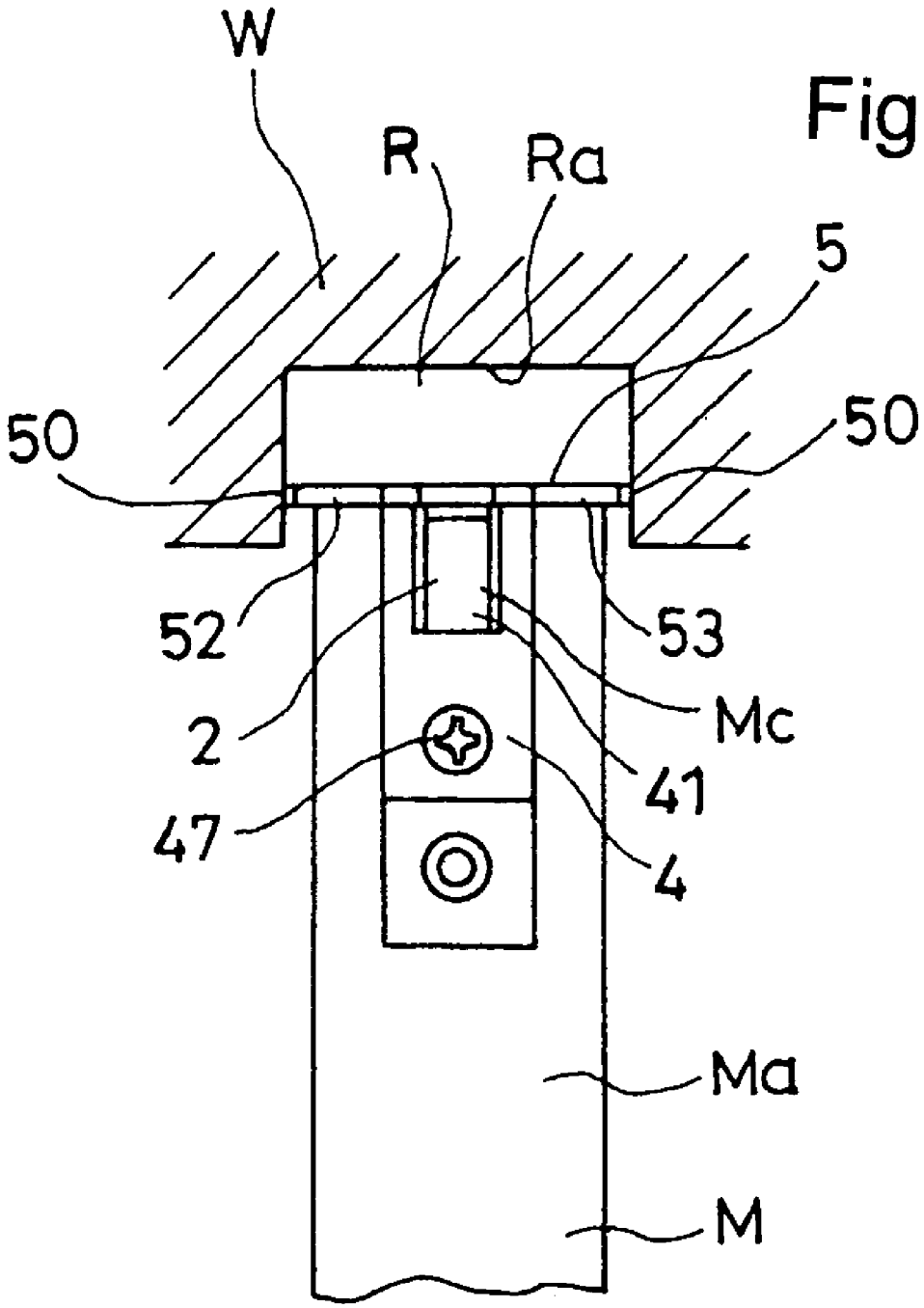
FIG. 3 is a schematic front view of the self-propelled forward movement system.
Figure 4:
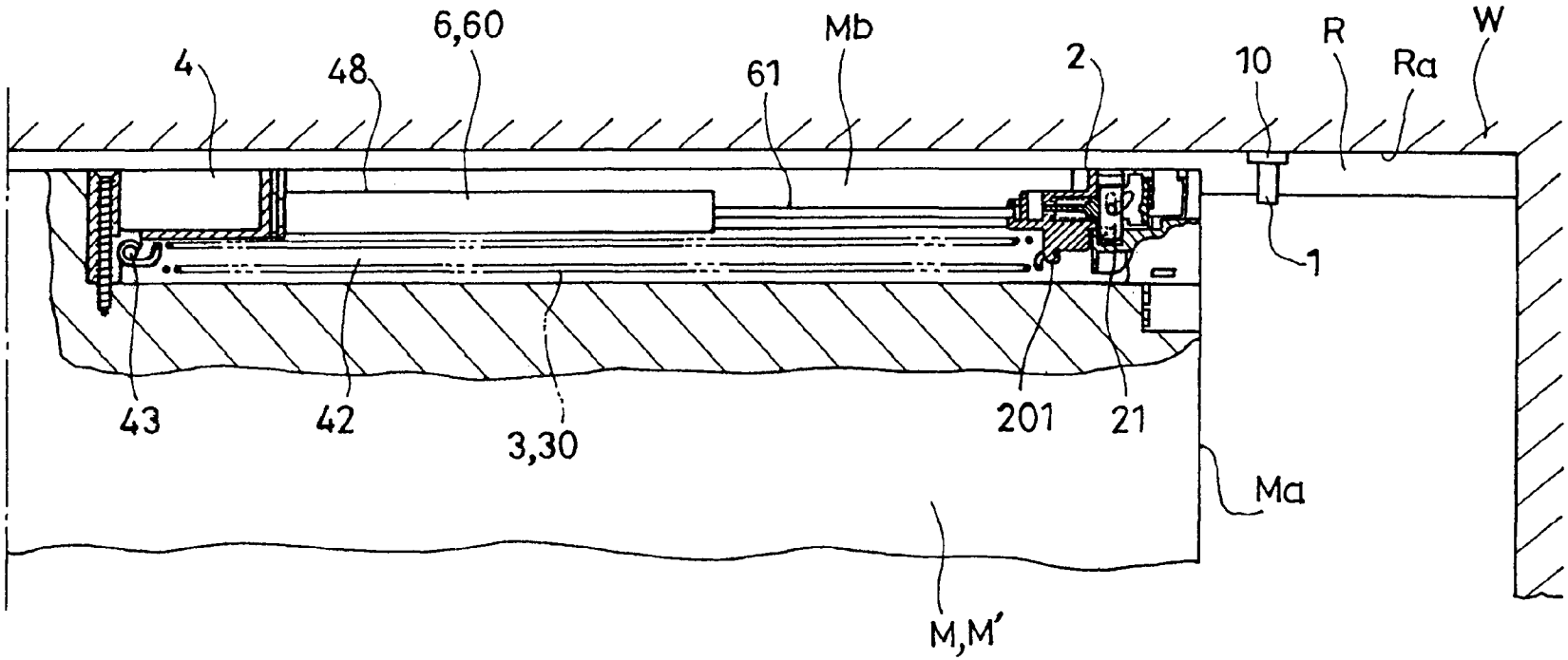
FIG. 4 is a schematic side view of the self-propelled forward movement system, wherein essential parts are shown in section.
Figure 5:
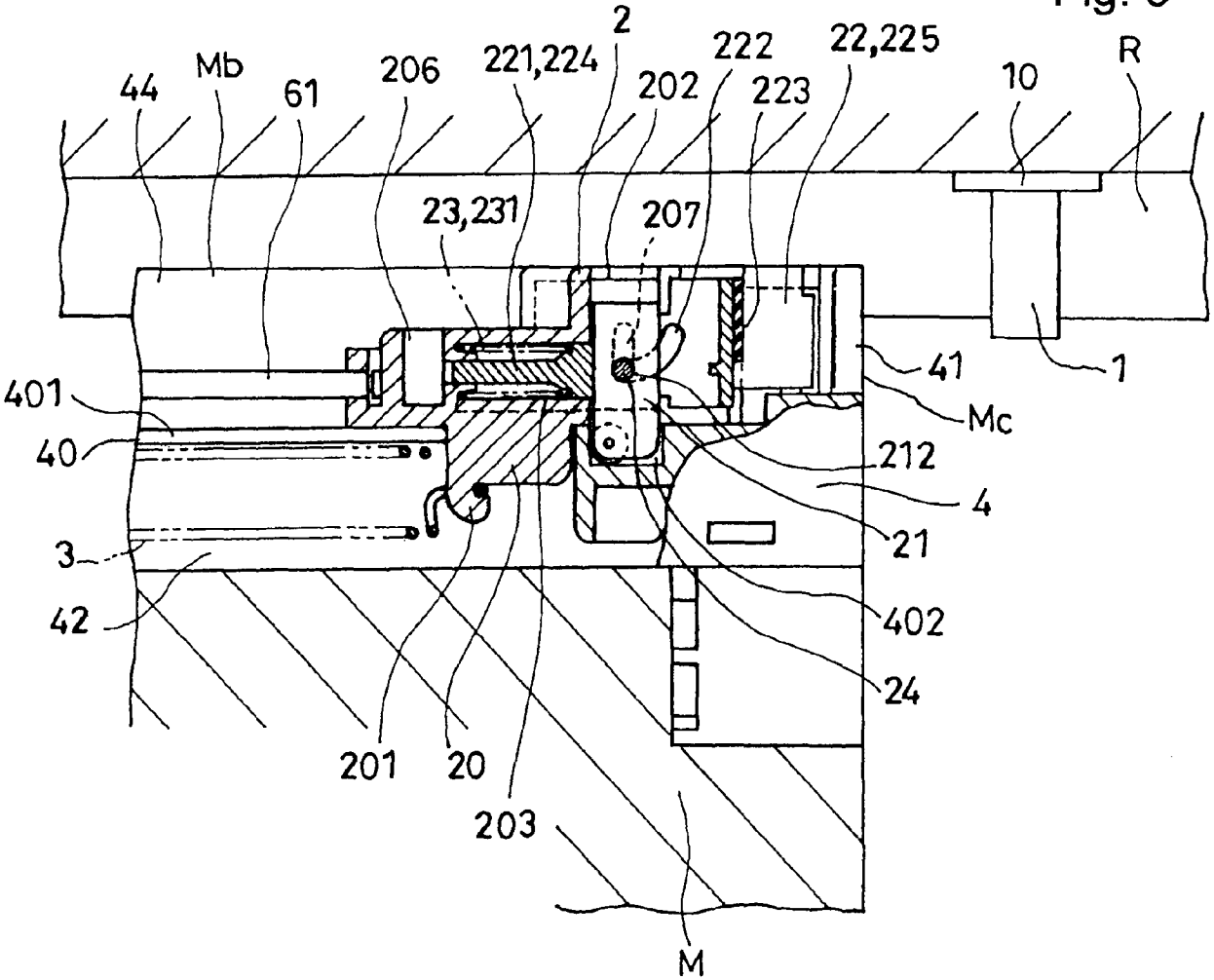
FIG. 5 is an enlarged view of essential parts shown in FIG. 4.
Figure 6:
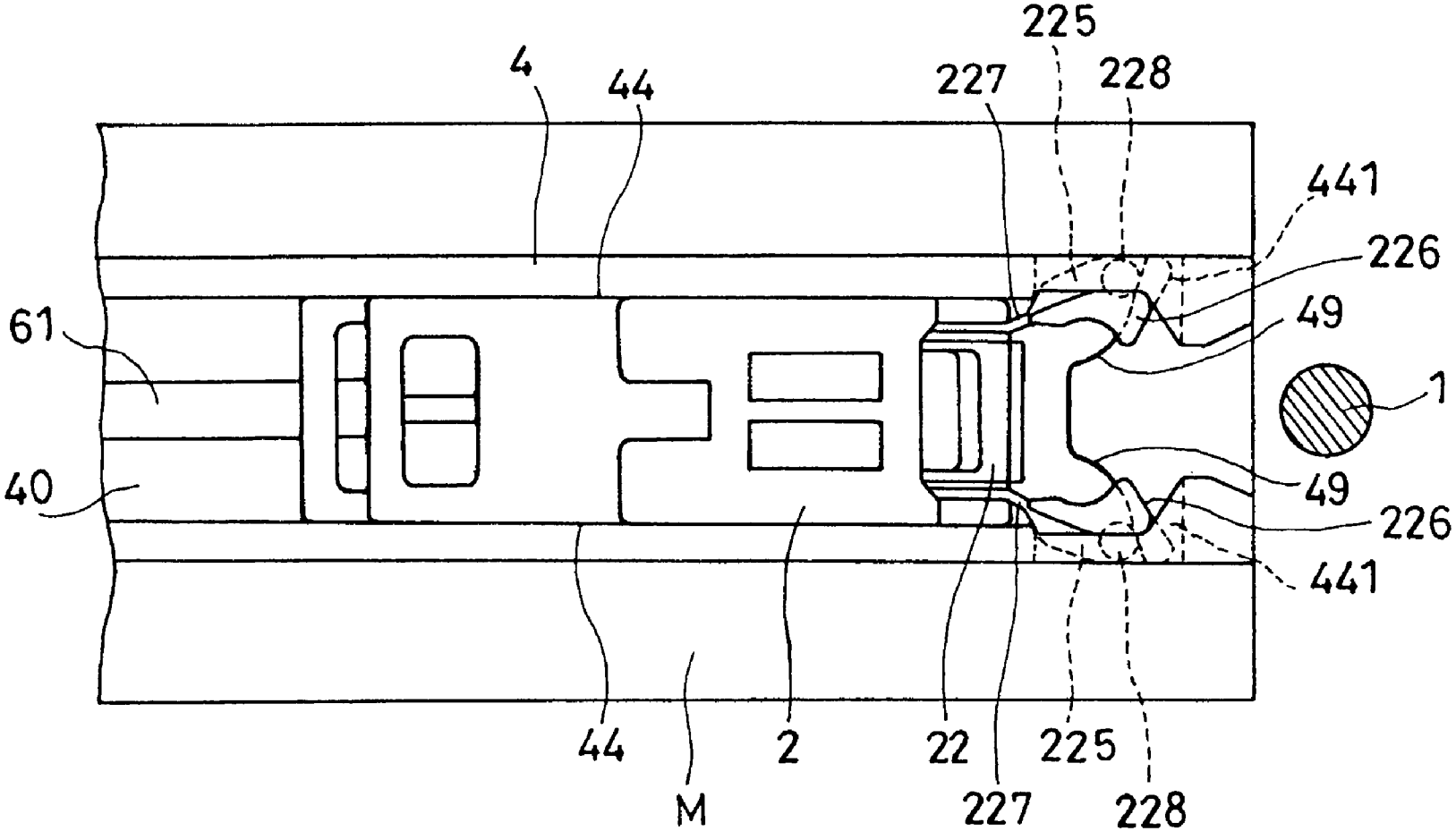
FIG. 6 is an enlarged plan view of essential parts in the state shown in FIG. 4.
Figure 7:
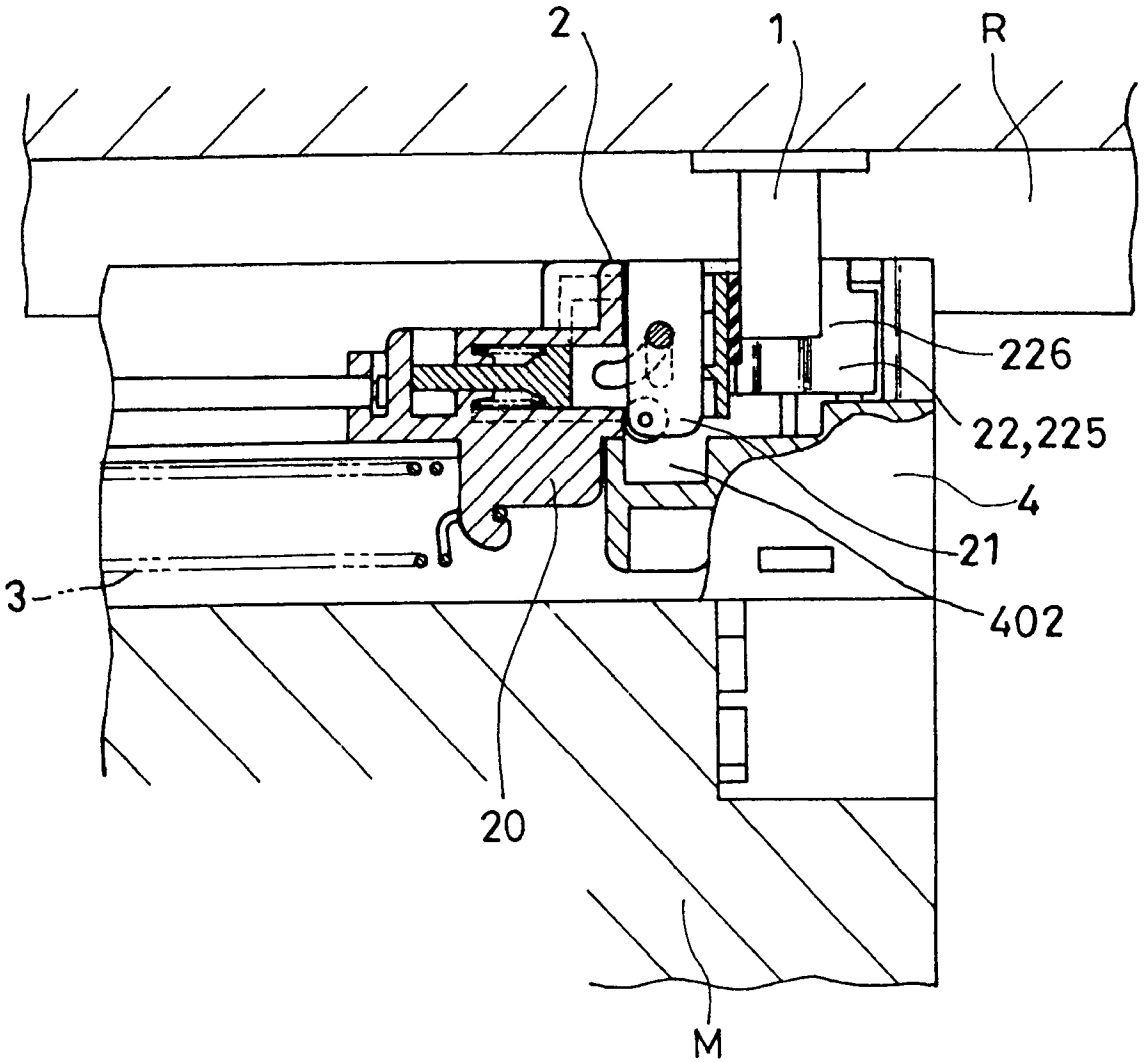
FIG. 7 is an enlarged view of the self-propelled forward movement system, wherein the movable member M according to the embodiment has arrived at a self-propelled movement start position.
Figure 8:
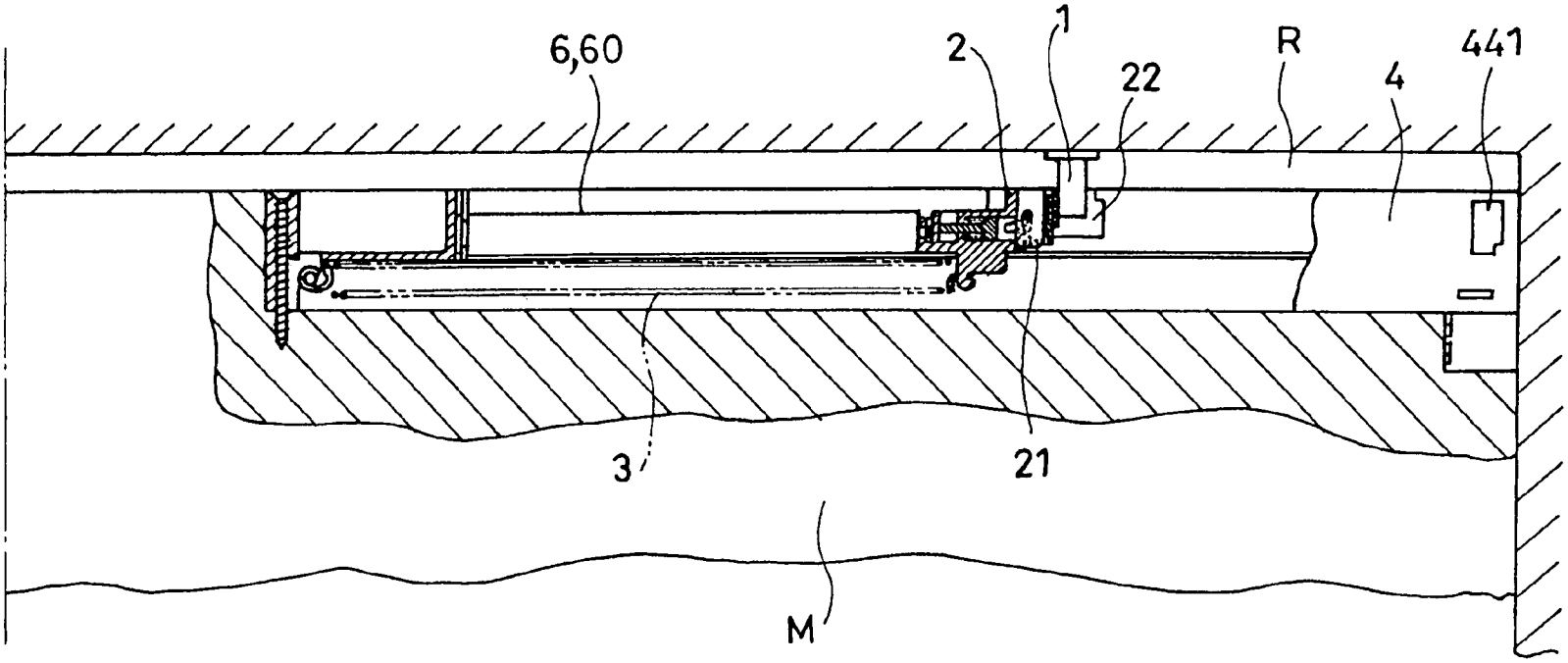
FIG. 8 is a schematic side view of the self-propelled forward movement system, wherein essential parts are shown in section.
Figure 9:
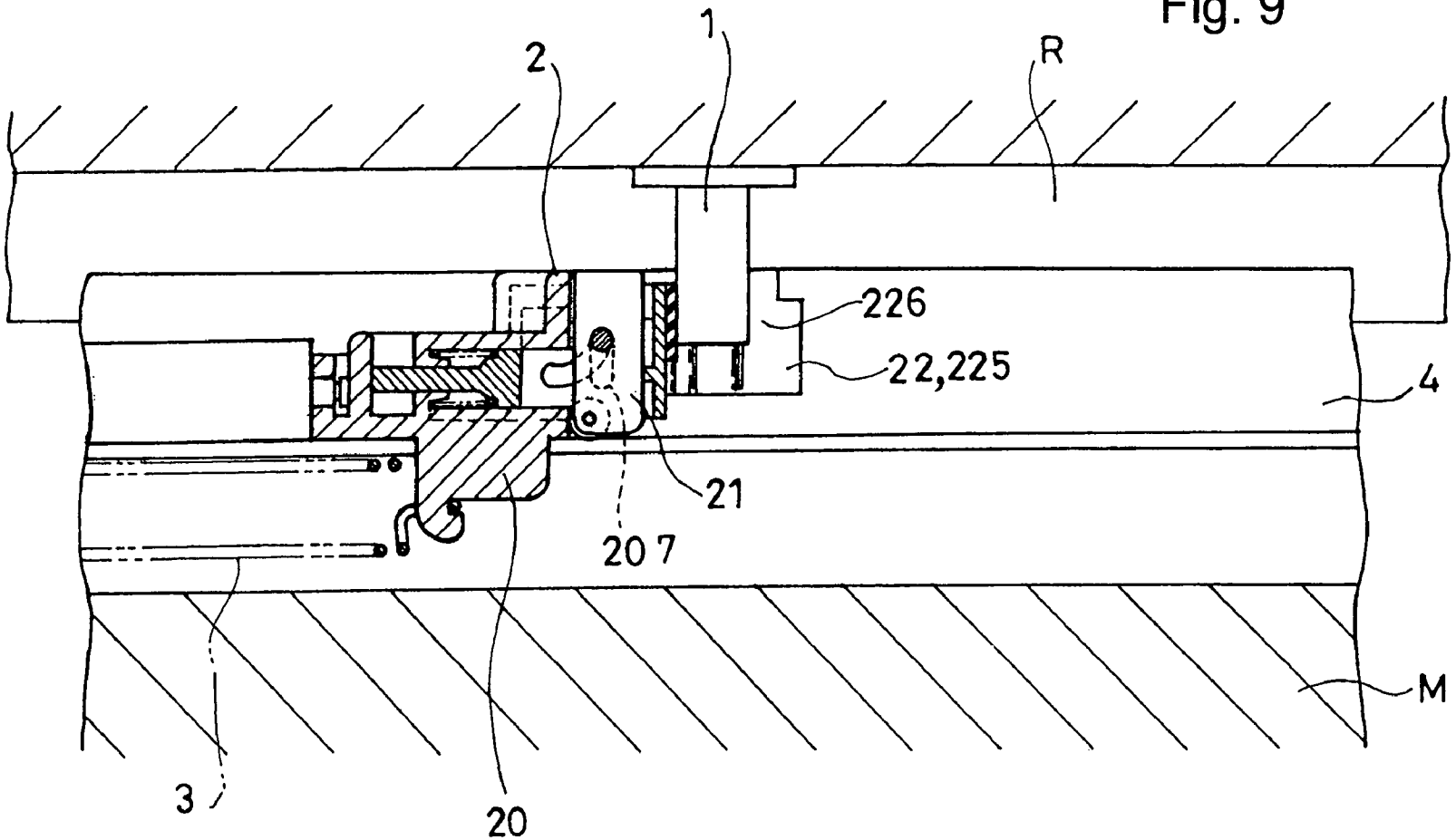
FIG. 9 is an enlarged view of essential parts shown in FIG. 8.
Figure 10:
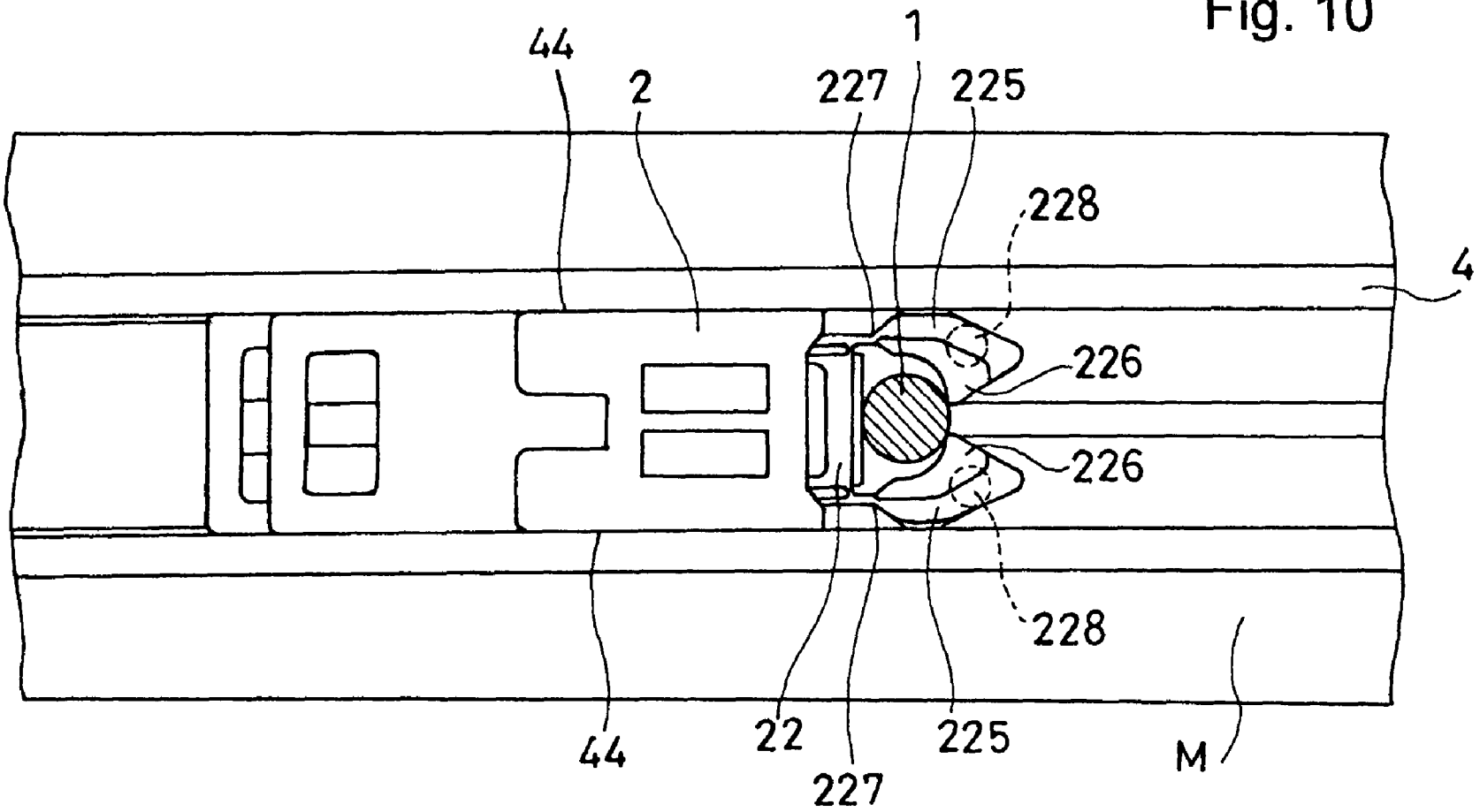
FIG. 10 is an enlarged plan view of essential parts in the state shown in FIG. 8.
Figure 11:
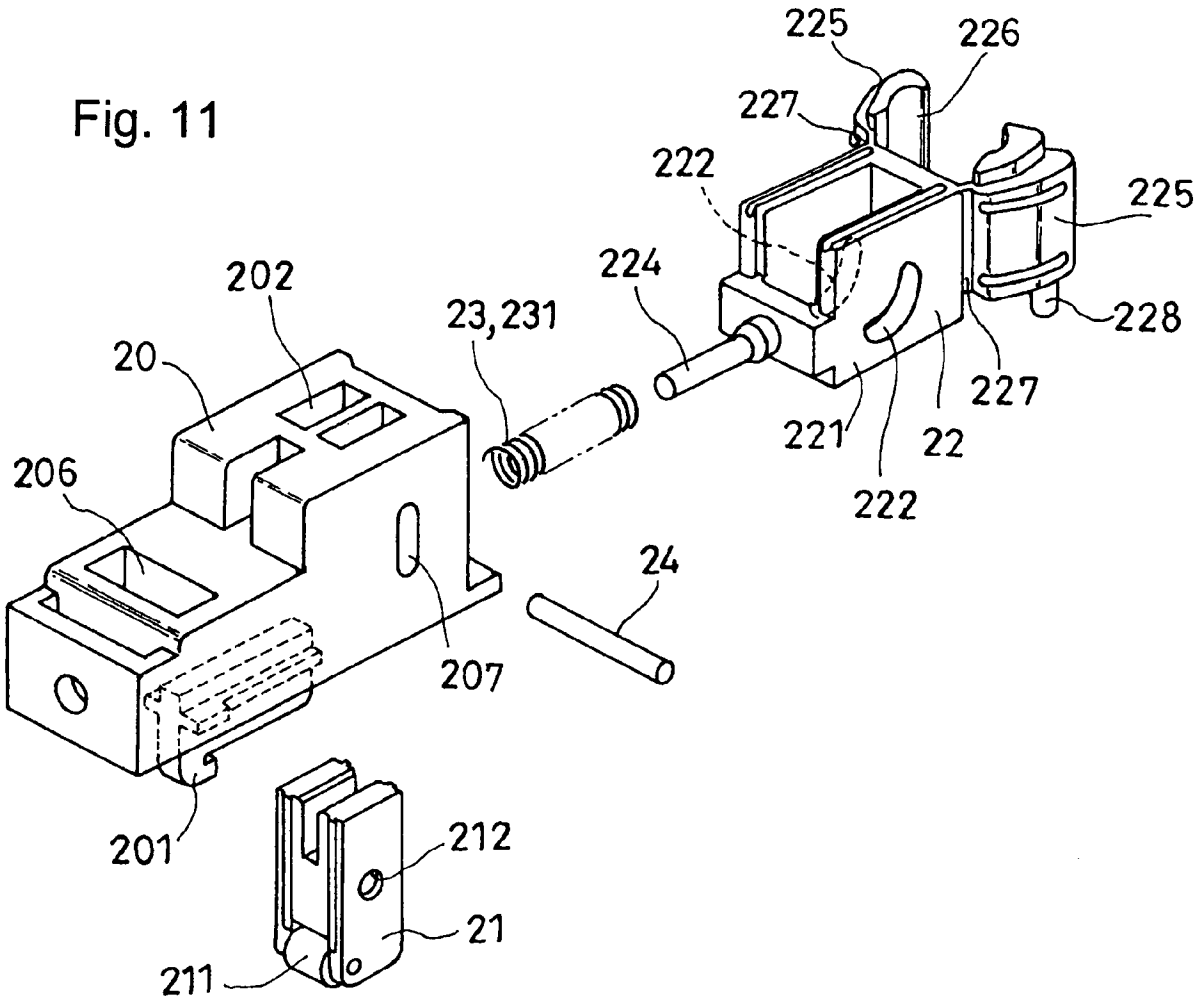
FIG. 11 is a schematic perspective view of the catcher according to the embodiment in a disassembled state.
Figure 12:
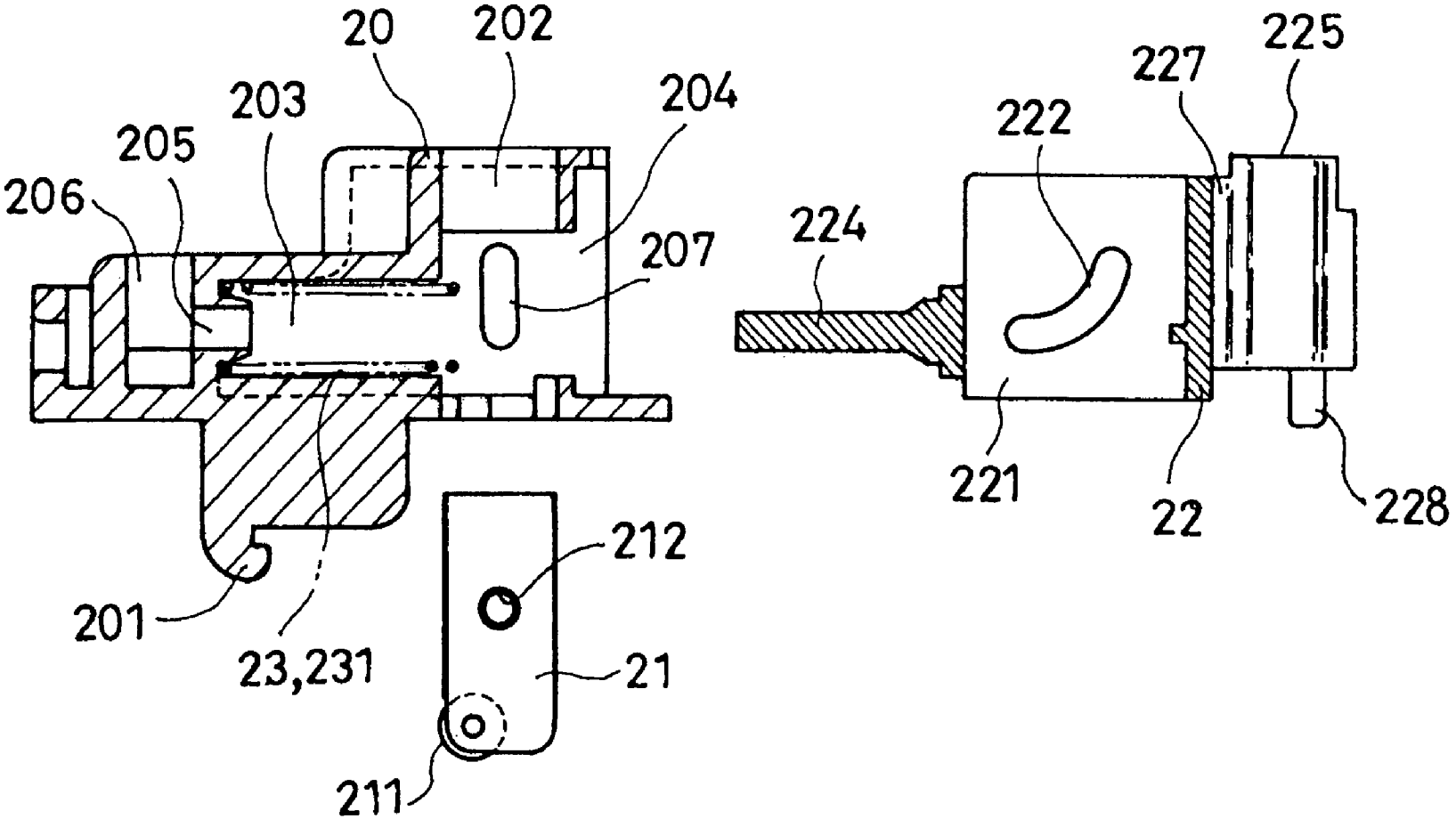
FIG. 12 is a schematic cross-sectional view of the catcher in a disassembled state.

Each of FIG. 1 to FIG. 3 shows how the self-propelled forward movement system according to an embodiment of the present invention is incorporated into a movable member M. Each of FIG. 4 to FIG. 6 shows how the movable member M is manually moved forward toward a self-propelled movement start position, FIG. 7 shows how after the movable member M has arrived at the self-propelled movement start position by the manual forward movement, a holder 22 forming a catcher 2 is retracted, and a catcher stopper 21 is withdrawn, and each of FIG. 8 to FIG. 10 shows how the movable member M is subsequently automatically moved forward. Each of FIG. 11 and FIG. 12 shows respective parts forming the catcher 2 in a disassembled state. FIG. 13 to FIG. 16 show spacers 5, which serve to provide a gap between the movable member M and a rail-like member R.

The self-propelled forward movement system according to this embodiment serves to automatically move the movable member M forward up to a stop position after the movable member M has been moved forward to the self-propelled movement start position, the movable member having an upper portion housed in and supported by the rail-like member R. The movable member M may be typically a sliding door, an overhung door, a bifold door or the like.

In the shown case, the system is applied to a sliding door M'. The rail-like member R is configured to provide a groove for housing an upper portion of the sliding door M'. In the shown case, the rail-like member R is disposed in a lower side of an upper frame W defining an opening to be selectively opened and closed by the sliding door M'. In a case where the system is applied to the sliding door M', when the sliding door M' is manually closed (moved forward) to a desired self-propelled movement start position, the sliding door M' is automatically moved forward up to a stop position where a front edge Ma of the sliding door M' strikes against a door stop post or a front edge of a sliding door as the counterpart.

The system includes (1) a striker 1, (2) the catcher 2, and (3) a biasing member 3 for the catcher 2.

The striker 1 is disposed in the rail-like member R.

The movable member M is automatically moved forward up to the stop position from a position where the catcher 2 captures the striker 2. In the shown case, the striker 1 is formed as a shaft-like member, which protrudes vertically downward from a lower side of a mounting member 10. The striker is disposed in the rail-like member R so as to be located at a substantially middle position in a width direction of the rail-like member R by fixing the mounting member 10 to a groove bottom Ra of the rail-like member R. The striker 1 is configured to enter a recess Mb formed in the movable member M described later from an open end Mc of the recess Mb close to the front end Ma of the movable member M when the movable member M is moved forward to the self-propelled movement start position.

The catcher 2 is housed in the recess Mb so as to be movable along a moving direction of the movable member M, the recess being formed in the upper portion of the movable member M so as to extend along the moving direction.

In the shown case, the sliding door M' as the movable member M is an upper portion formed with an incorporated recess, which is open forward at the front end Ma and open upward and extends along the moving direction of the sliding door M'. In the shown case, the catcher 2 is disposed in the upper portion of the movable member M by disposing an elongated casing 4 in the incorporated recess and housing the catcher 2 so as to be movable in a longitudinal direction of the casing 4, the casing being open upward. In other words, the casing 4 serves as the recess Mb in the shown case.

The casing 4 is roughly divided into an upper space and a lower space by a partition 40 disposed at a substantially middle position in a vertical direction. The casing 4 has the upper space (upper compartment 48) above the partition 40 formed so as to, be open at a front end thereof located at the front end Ma of the movable member M, so that the striker 1 enters the casing 4 from an inlet 41 of the casing 4 when the movable member M is moved to the self-propelled movement start position. The partition 40 has a slot 401 formed therein at a substantially middle position in a width direction thereof between the front end thereof and a middle portion in the longitudinal direction thereof, so that a hook 201, which is formed on a rear end of a catcher body 20 described later, enters the lower compartment 42 of the casing through the slot 401. The lower compartment 42 houses a helical extension spring 30, which has a front end fixed to the hook 201 of the catcher body 20 and a rear end fixed to a hook 43 disposed on a rear end of the casing 4. The partition 40 has a downward recess formed therein between a front end of the slot 401 and the front end of the casing 4, so that the helical extension spring 30 is extended to the maximum when the catcher 2 is set a reference position where a catcher stopper 21 described later enters the downward recess. In other words, the downward recess serves as an engageable hole 402 for the catcher stopper 21. The casing 4 has right and left sidewalls cut-out between the engageable hole 402 and the front end of the casing 4, so that holding flaps 225 of the holder 22 described later have outer portions entering the cut-out portions 441 to set the holder in a non-holding state when the catcher 2 is set at the reference position.

In this embodiment, the casing 4 has the spacer 5 disposed at a substantially middle position in the longitudinal direction thereof.

The spacer 5 is disposed in order to constantly provide a gap between an inner surface of the rail-like, member R and the right and left sidewalls so as to allow the movable member M to smoothly move along the rail-like member R. The spacer has protruding sliders 50 protruding laterally on both right and left sides of the movable member M.

Figure 13:
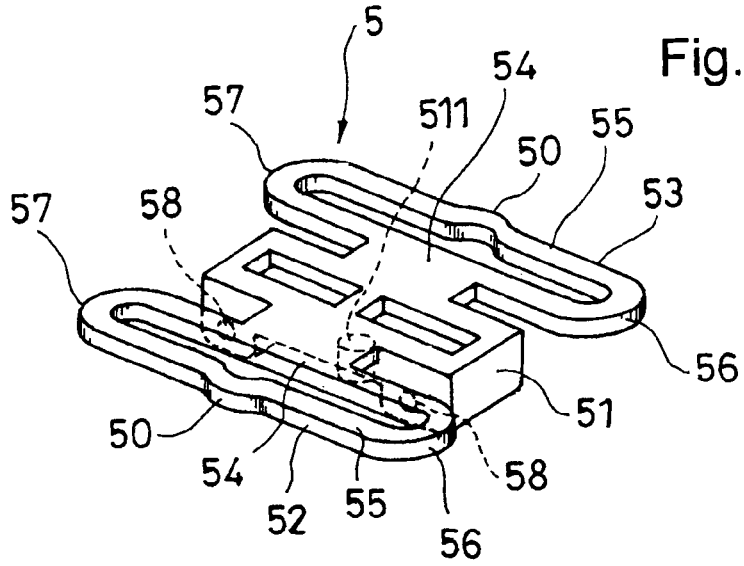
FIG. 13 is a schematic perspective view of the spacer according to the embodiment.

In the case shown in FIG. 13, the spacer 5 is specifically formed of a central portion 51 having a width equal to about one half of the width of the casing 4 and extending in the longitudinal direction of the casing 4, a left portion 52 protruding toward a left direction from the central portion 51, and a right portion 53 protruding toward a right direction from the central portion 51. Each of the left portion 52 and the right portion 53 is formed of a connection base 54, an elastic strip 55, a front connection portion 56, and a rear connection portion 57, the connection base having a lower side located at a higher level than a top end of the casing 4 and a central side integrally connected to the central portion 51 and extending in parallel with the central portion 51, the elastic strip extending in the same direction as the connection base 54 so as to be apart from the connection base 54, the front connection portion integrally connecting a front end of the connection base 54 and a front end of the elastic strip 55, and the rear connection portion integrally connecting a rear end of the connection base 54 and a rear end of the elastic strip 55. Each of the protruding sliders 50 is formed as a bulge, which protrudes laterally from an outer side of each elastic strip 55 in a thick-wall direction at a substantially central part of the elastic strip 55, and which is arced as viewed in a plan view. The protruding slider 50 of the left portion 52 and the protruding slider 50 of the left portion 53 have a pitch therebetween set so as to be substantially equal to the width of the rail-like member R. Each of the elastic strips 55 is configured so as to be elastically deformable in a direction to be away from the inner surface of the rail-like member R.

By this arrangement, in this embodiment, the movable member M is supported through the protruding slider 50 by the rail-like member R without wobbling in such a state that the sliding resistance of the movable member M during movement is minimized by keeping the upper portion of the movable member M out of contact with the inner surface of the rail-like member R. The spacer 5 centers the movable member M so that the movable member has a substantially middle portion in a width direction set at a substantially middle portion of the rail-like member R in the width direction. Thus, the striker 1 is reliably captured by the catcher when the catcher is set in the reference position in the recess Mb in a case where the movable member M is moved forward to the self-propelled movement start position. The protruding sliders 50 are disposed on the elastic strips 55. Accordingly, when a pressing force is applied to the movable member M toward either one of the right side and the left side of the rail-like member R, the elastic strips 55 are deformed to allow the movable member M to shift toward the one side, and when the pressing force is released, the elastic strips 55 are elastically restored to the original state to reset the movable member M in the initial position.

Figure 14:
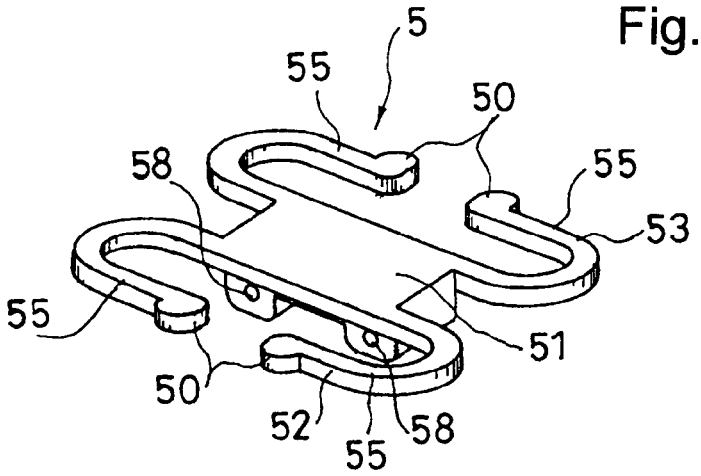
FIG. 14 is a schematic perspective view of the spacer according to another embodiment of the present invention.
Figure 15:
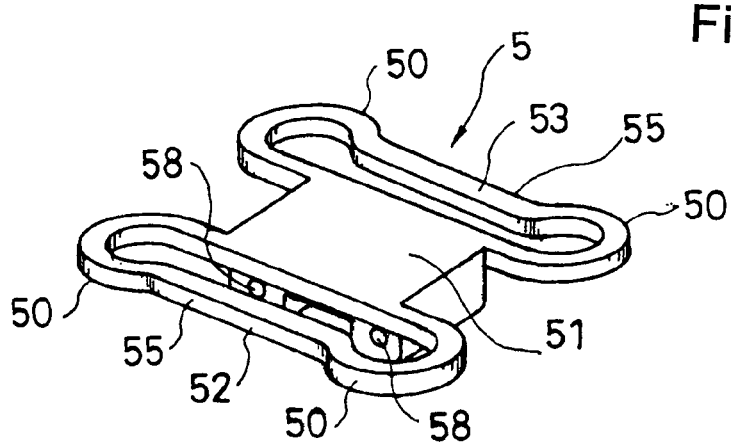
FIG. 15 is a schematic perspective view of the spacer according to another embodiment of the present invention.
Figure 16:
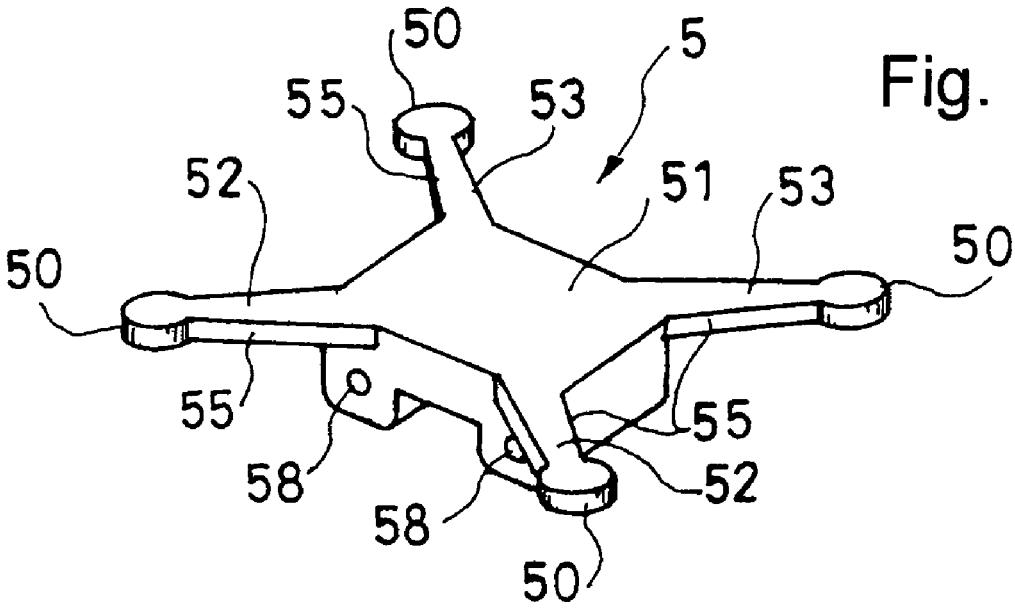
FIG. 16 is a schematic perspective view of the spacer according to another embodiment of the present invention.

The spacer 5 may be formed of a pair of elastic strips 55 and a central portion 51, each of the elastic strips being formed in a C-character shape as viewed in a plan view and having protruding sliders formed on both ends, and the elastic strips being integrally connected back-to-back at the central portion as shown in FIG. 14. The spacer 5 may be formed of a pair of elastic strips 55 and protruding sliders 50 formed on both ends of each of the elastic strips as shown in FIG. 15. The spacer 5 may be formed of a substantially rectangular central portion 51, elastic strips 55 radially protruding from the four corners of the central portion, and protruding sliders 50 formed on leading ends of the elastic strips, the central portion having front and rear sides extending in a right-to-left direction as shown in FIG. 16.

In the shown cases, pins 45, which extend between the right and left sidewalls 44 and 44 of the casing 4, pass through respective through holes 58 formed in a front portion and a rear portion of the central portion 51 along the right-to-left direction. By this arrangement, each of the spacers is combined with the casing 4 so as to be movable in order to be capable of shifting for adjustment by a difference between the width of the central portion 51 and the width of the casing 4.

On the other hand, the casing 4 includes an adjuster 46, which is formed of:

a lower plate 461 extending along the bottom of the casing 4;

a rising part 462 rising from a front end of the lower plate 461, having an internally threaded hole formed therein, disposed in the lower compartment 42 of the casing 4, and having an adjusting screw 47 threaded in the internally threaded hole so as to be rotated by operation from a front side;

a rear rising part 463 rising from one edge of the lower plate 461 along a longitudinal direction of the lower plate in a rear side of the lower plate 461; and an upper plate 464 laterally protruding from a top end of the rear rising part 463 and entering under the central portion 51 of the spacer 5.

The adjuster 46 is configured to be movable in the longitudinal direction of the casing 4 by screwing and unscrewing the adjusting screw 47. The upper plate 464 of the adjuster 46 has a slot 465 formed therein so as to extend in a direction intersecting the longitudinal direction of the casing 4, and the central portion 51 of the spacer 5 has a projection 511 formed on a substantially middle position in the longitudinal direction of the central portion so as to enter the slot 465.

By this arrangement, the spacer 5 can be slightly moved in a right-to-left direction by screwing and unscrewing the adjusting screw 47 in the shown embodiment.

The catcher 2 includes the catcher stopper 21 disposed so as to be vertically movable with respect to the catcher body 20, the holder 22 for the striker 1, and a biasing member 23 for the catcher stopper and the holder, the holder being disposed so as to be movable forward and backward and receive the striker 1 from forward in the non-holding state.

The catcher stopper 21 is configured so that when a lower end of the catcher stopper 21 is projected downward by the biasing member 23, the holder 22 is set in a forward position and in the non-holding state, and when the holder 22 is set in a backward position and in a holding state, the lower end of the catcher stopper 21 is retracted upward.

In the shown embodiment, the catcher body 20 is configured to be elongated in the moving direction of the movable member M and to be housed within the width of the upper compartment 48 of the casing 4. The catcher body 20 has the hook 201 formed at a lower part of a rear side thereof. The catcher body 20 has a vertical operation hole 202 formed in a front side thereof so as to vertically pass therethrough. The catcher body 20 also has a horizontal operation hole 203 formed therein so as to have an inlet 204 at the front side thereof, extend toward the rear end side of the catcher body 20 and to intersect and communicate with the vertical operation hole 202. The catcher body 20 has an escape space 206 formed therein between an inner end of the horizontal operation hole 203 and a rear end thereof and a through hole 205 formed in the inner end of the horizontal operation hole 203 so as to communicate with the escape space 206.

In the shown embodiment, the catcher stopper 21 is formed in such a shaft-like shape as to have a roller 211 at a lower end thereof and a through hole 211 formed in a middle portion thereof so as to pass therethrough in a right-to-left direction. The catcher stopper is configured so that the lower end thereof comes in and out of a lower opening of the vertical operation hole 202.

On the other hand, the holder 22 includes a slider 221 having upper and lower ends opened and formed in a rectangular frame-like shape, a shaft 224 extending backward from a rear end of the slider 221, and the paired holding flaps 225 and 225 disposed on a front end of the slider 221. The paired holding flaps 225 and 225 have projections 226 formed therein so as to project inward in directions to confront each other. The paired holding flaps 225 and 225 are integrally formed with the slider 221 through elastically deformable resin hinges 227 so that the projections 226 are set in the non-capturing state where the distance between front ends of the projections is greater than the diameter of the striker 1.

Specifically, the right holding flap 225 is jointed to the slider 221 through the resin hinge 227 extending between a rear end of the right holding flap and a right front ridge of the slider, while the left holding flap 225 is jointed to the slider 221 through the resin hinge 227 extending between a rear end of the left holding flap and a left front ridge of the slider. When the catcher 2 is set in the reference position, the holder 22 is set in the forward position, where the holding flaps 225 are allowed to spread outward by the elasticity of the resin hinges 227 because of the provision of the cut-out portions 441 in the casing 4 (see FIG. 6 where the outer portions of the holding flaps 225 enter the cut-out portions 441). When the movable member M is moved forward to the self-propelled movement start position, the striker 1 strikes against the front end of the slider between the rear ends of the paired holding flaps 225 and 225, and the slider 221, consequently the holder 22 is pressed toward the backward position. In the shown embodiment, the front end of the slider 221 is covered with a cushioning material 223. When the holder 221 has been pressed into the backward position, the paired holding flaps 225 and 225 get out of the cut-out portions 441 and are retracted inward, being pressed by the side walls 44 of the casing 4. As a result, the paired holding flaps makes the distance between the projections 226 narrower than the diameter of the striker 1 and captures the striker 1 in the inward position of the projections 226. Thus, the striker 1 is captures by the catcher 2.

The slider 221 is formed of right and left frame plates, each of which has a curved guide slot 222 formed therein so as to pass therethrough in such a way that the guide slot has a top end positioned forward, a bottom end positioned backward and an outer curved side facing obliquely forward and downward.

The catcher body 20 has vertically elongated slots 207 formed in both right and left lateral sides of a portion thereof where the horizontal operation hole 203 intersect the vertical operation holes 202, the vertically elongated slots passing through the lateral sides.

In the shown case, the catcher stopper 21 and the holder 22 are assembled in the catcher body 20 by passing a pin 24 through the respective vertically elongated slots 207, the respective curved guide slots 222 and the through hole 212 in such a state that the slider 221 of the holder 22 is put into the horizontal operation hole 203 while the shaft 224 leads the remaining parts of the holder, and that the catcher stopper 21 is put into the slider 221 of the holder 22 from the vertical operation hole 202. The holder 22 has a helical compression spring 231 disposed on and around the shaft 224, which has a rear end constantly brought into contact with the inner end of the horizontal operation hole 203 and a front end constantly brought into contact with the rear end of the slider 221.

The holder 22 is constantly biased forward by the helical compression spring 231, and the catcher stopper 21 is constantly biased downward through the holder 22 thus biased. In other words, in the shown case, the helical compression spring 231 serves as the biasing member 23.

Before the movable member M has been moved forward to the self-propelled movement start position, the holder 22 protrudes forward to the maximum, with the result that the pin 24 is located at the bottom ends of the vertical guide slots 207 and the bottom ends of the curved guide slots 222, and that the lower portion of the catcher stopper 21 enters the engageable hole 402 (see FIG. 5 where the catcher 2 is set in the reference position). When the movable member M has been moved forward to the self-propelled movement start position, the striker 1 enters the recess Mb from forward, and the holder 22 is moved backward against the action of the biasing member 23, being pressed by the striker 1 thus entering (from FIG. 5 to FIG. 7). The backward movement of the holder 22 is allowed by pushing the shaft 224 into the escape space 206 through the through hole 205. When the holder 22 has been moved backward, the holding flaps 225 get out of the cut-out portions 441 of the casing 4. While the resin hinges 227 are elastically deformed by the right and left side walls 44 and 44 of the casing 4, the paired holding flaps 225 and 225 are set in the holding state where the distance between the front end of the projections 226 is smaller than the diameter of the striker 1. Thus, the catcher 2 is united with the striker 1. At the same time, the catcher stopper 21 is moved upward to get out the engageable hole 402 formed in the casing 4 by the backward movement of the holder 22. When the catcher stopper 21 is disengaged from the engageable hole 402 of the casing 4, the movable member M is automatically moved up to the stop position by elastic recovery because of being allowed to be elastically restored in a direction for the helical extension spring 30 to be compressed (see FIG. 8 to FIG. 10). When the movable member is automatically moved, the roller 211 of the catcher stopper 21 rotates, being brought into contact with portions of the partition 40 on both sides of the slot 401 in the forwardly moving casing 4. When the automatic forward movement is completed, the catcher 2 is relatively retracted to a substantially middle position of the casing 4 in the longitudinal direction.

The catcher 2, which has been united with the striker 1, is relatively forward moved, storing a force in the biasing member 3, by the backward movement of the movable member M from the stop position. When the movable member M arrive at the self-propelled movement start position, the catcher stopper 21 enters and is brought into engagement with the engageable hole 402 of the casing 4 under the biasing action of the biasing member 23. At the same time, the holder 22 is allowed to be moved forward in the biasing action of the biasing member 23, and the holder 22 is returned to the non-holding state, separating the catcher 2 and the striker 1 from each other (FIG. 5). Thus, the system returns to the initial state.

In the shown embodiment, the paired holding flaps 225 and 225 of the holder 22 have cam followers 228 formed on front sides thereof so as to protrude downward, and the partition 40 of the casing 4 has cams 49 formed on an upper front surface thereof so that the cams guide the cam followers 22 to cause the holding flaps 225 to enter the cut-out portions 441 when the movable member M has been backward moved up to the self-propelled movement position.

In this embodiment, the recess Mb has a damper 6 incorporated therein so as to apply a breaking force to a relative movement of the catcher 2.

In the shown case, the upper compartment 48 of the casing 4 houses the damper 6, which includes a cylinder 60 and an unshown piston, and which is configured to apply resistance to the piston when the piston enters the cylinder 60. In the shown case, the cylinder 60 has a rear end fixed to the rear end of the casing 4, and the piston rod 61 has a front end fixed to a rear end of the catcher 2. The damper is configured so that the piston rod 61 protrudes from the cylinder 60 to the maximum when the catcher 2 is set in the reference position. In the shown case, the system is configured so that the catcher 2 reaches the end of the limit of its relative backward movement when the piston rod 61 enters the cylinder 60 to the maximum. Thus, in this embodiment, it is possible to provide the automatic movement of the movable member M with a feeling of a high grade and to reduce collision noise at the time of stopping by moderating the power of the relative movement of the catcher caused by the automatic forward movement of the movable member M beyond the self-propelled movement start position.

The entire disclosure of Japanese Patent Application No. 2006-116587 filed on Apr. 20, 2006 including specification, claims, drawings and summary is incorporated herein by reference in its entirety.

The invention claimed is:

1. A self-propelled forward movement system, which is adapted to automatically move a movable member forward up to a stop position after the movable member is moved forward to a self-propelled movement start position, the movable member being adapted to have an upper portion housed in and supported by a rail member, comprising:

a striker configured to be disposed in the rail member;

a catcher configured to be housed in a recess so as to be movable along a moving direction of the movable member, the recess being formed in the upper portion of the movable member so as to extend along the moving direction;

a biasing member for the catcher;

the catcher including a catcher stopper, a holder for a striker, and a biasing member for the catcher stopper and the holder, the catcher stopper being disposed so as to protrude and enter with respect to a catcher body, the holder being disposed so as to be movable forward and backward and receive the striker from forward in a non-holding state;

the catcher stopper being configured so that when the catcher stopper protrudes from the catcher body, the holder is set in a forward position and in the non-holding state by the biasing member, and when the holder is set in a backward position and in a holding state, the catcher stopper is withdrawn into the catcher body; and the recess having an engageable hole, which the catcher stopper is brought into engagement with when protruding, the engageable hole being disposed to store a force in the biasing member when the catcher is set in a reference position where the catcher stopper is brought into engagement with the engageable hole;

wherein the striker enters into the holder of the catcher when the catcher is set in the reference position in a case where the movable member is moved forward to the self-propelled movement start position.

2. The system according to claim 1, wherein the holder comprises a slider and a pair of right and left holding flaps, the slider being combined with the catcher body so as to be movable in forward and backward directions, and the slider being integrally jointed to the paired holding flaps by hinges formed of resin, which extend between a front end of the slider and rear ends of the holding flaps.

3. The system according to claim 2, wherein the recess comprises an inner wall extending along the moving direction of the movable member, the inner wall having cut-out portions partly formed therein so as to receive at least outer portions of the holding flaps of the catcher under an elastic action of the hinges when the catcher is set in the reference position.

4. The system according to claim 1, further comprising a spacer having protruding sliders, which protrude laterally on both right and left sides of the movable member so as to constantly provide a gap between an inner surface of the rail member and each of both right and left sides of the movable member.

5. The system according to claim 4, wherein the spacer comprises elastic strips, which are elastically deformable in a direction to be away from the inner surface of the rail member, the elastic strips having the protruding sliders disposed thereon.

6. A sliding door, comprising:

the self-propelled forward movement system according to claim 1.

* * * * *